United States Patent [19]

Kobayashi et al.

[11] 4,411,987

[45] Oct. 25, 1983

[54] SILVER HALIDE COLOR PHOTOGRAPHIC LIGHT-SENSITIVE MATERIAL

[75] Inventors: Hidetoshi Kobayashi; Toshiyuki Watanabe; Keiichi Adachi; Tadashi Ogawa, all of Minami-ashigara, Japan

[73] Assignee: Fuji Photo Film Co., Ltd., Kanagawa, Japan

[21] Appl. No.: 440,044

[22] Filed: Nov. 8, 1982

[30] Foreign Application Priority Data

Nov. 6, 1981 [JP] Japan ..... 56-177989

[51] Int. Cl.[3] ..... G03C 1/02; G03C 1/40

[52] U.S. Cl. ..... 430/542; 430/505; 430/543; 430/551; 430/544; 430/548; 430/554; 430/630; 430/961

[58] Field of Search ..... 430/214, 543, 551, 615, 430/542, 510, 961, 544, 548, 554, 505, 630

[56] References Cited

U.S. PATENT DOCUMENTS

| | | | |
|---|---|---|---|
| 2,309,492 | 1/1943 | Albers | 430/420 |
| 2,708,161 | 5/1955 | Jones | 430/614 |
| 2,708,162 | 5/1955 | Carroll et al. | 430/614 |
| 2,735,769 | 2/1956 | Allen et al. | 430/615 |
| 3,141,771 | 7/1964 | Bard et al. | 430/214 |
| 3,295,981 | 1/1967 | Milton | 430/621 |
| 3,770,431 | 11/1973 | Gates et al. | 430/214 |
| 3,811,891 | 5/1974 | Darlak et al. | 430/505 |
| 4,069,052 | 1/1978 | Lohmer et al. | 430/551 |

*Primary Examiner*—J. Travis Brown

*Attorney, Agent, or Firm*—Sughrue, Mion, Zinn, Macpeak and Seas

[57] ABSTRACT

A silver halide color photographic light-sensitive material containing an unsubstituted or substituted glycoluril as an aldehyde gas scavenger. The silver halide color photographic light-sensitive material of the present invention can avoid the decrease in color density and the formation of fog normally present when the silver halide color photographic light-sensitive material is stored for a long period of time in contact with formaldehyde gas. In addition, the silver halide color photographic light-sensitive material of the present invention has a reduced layer thickness and good film strength.

38 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, and more particularly it relates to an improved silver halide color photographic light-sensitive material in which the degradation of photographic properties is prevented even when the material is brought into contact with formaldehyde gas during storage.

BACKGROUND OF THE INVENTION

Furniture and construction materials processed with formalin, adhesives containing formalin as a hardening agent, goods made of formaldehyde resins, leather goods tanned with formalin, clothes treated with formalin as a sterilizer or a bleaching agent, and the like are frequently utilized in daily life. As a result, there are many opportunities for conventional photographic light-sensitive materials to be brought into contact with formaldehyde gas released from these commonly used items.

In general, a silver halide color photographic light-sensitive material is composed of a support having coated thereon silver halide emulsion layers each of which has sensitivity in a different region of the spectrum and each of which contains a coupler capable of reacting with an oxidation product of a color developing agent to form a dye. For example, conventionally a color photographic material contains silver halide emulsion layers each of which is sensitive to blue light, green light or red light and contains a yellow coupler, a magenta coupler or a cyan coupler, respectively. After exposure to light, the photographic material is subjected to color development processing to form yellow, magenta and cyan color dye images in these silver halide emulsion layers, respectively. In such a multilayer color photographic material, each silver halide emulsion layer should be well balanced with respect to sensitivity and gradation in order to obtain an excellent color image. It is also desirable that the photographic properties of the photographic material are not changed during long period storage either before or after exposure to light until it is subjected to color development processing.

However, when a conventional silver halide color photographic light-sensitive material is brought into contact with formaldehyde gas before color development processing, not only is the coupler incorporated therein consumed by the reaction with formaldehyde but an undesirable product is also formed. As a result, degradation of the photographic properties, for example, a decrease in color density, an increase in color stain and fog, etc., occurs. The degradation of photographic properties due to formaldehyde gas is serious with the so-called 4-equivalent couplers having an active methylene group. Particularly, magenta couplers tend to be adversely affected by formaldehyde.

It has been proposed that a compound which reacts with formaldehyde be incorporated into a silver halide color photographic light-sensitive material containing a coupler for the purpose of preventing the degradation of photographic properties due to formaldehyde gas. However, known compounds for preventing the degradation of photographic properties due to formaldehyde gas in silver halide color photographic light-sensitive materials which contain an oil-soluble 4-equivalent magenta coupler, as described in Japanese Patent Publication Nos. 34675/71, 38418/73 and 23908/76, U.S. Pat. Nos. 3,770,431 and 3,811,891, *Research Disclosure,* Vol. 101, No. 10133, etc., only have a limited ability to fix formaldehyde gas. Therefore, adequate prevention of the degradation of the photographic properties cannot be obtained. Further, when such compounds are used in a large amount, a disadvantage is encountered. More specifically, the film properties of the photographic light-sensitive material are degraded. Further, some of these compounds tend to hinder the hardening activity of a hardening agent such as a vinylsulfonyl hardening agent, etc., which results in the disadvantage in that film properties of the photographic light-sensitive material are degraded. Moreover, some of these compounds cause the degradation of the photographic properties, for example, increase in fog, decrease in color density, decrease in gamma, decrease in sensitivity, etc., by the incorporation thereof into the light-sensitive layer.

SUMMARY OF THE INVENTION

Therefore, an object of the present invention is to provide a silver halide color photographic light-sensitive material in which the degradation of the photographic properties such as a decrease in color density and an increase in fog, etc., are prevented even when the photographic light-sensitive material is brought into contact with formaldehyde during long periods of storage prior to color development processing.

Another object of the present invention is to provide a silver halide color photographic light-sensitive material having a reduced emulsion layer thickness and thus improved sharpness, as well as having good film strength, when the photographic light-sensitive material contains an aldehyde gas scavenger in a sufficient amount for improving the resistivity to formaldehyde.

A further object of the present invention is to provide a silver halide color photographic light-sensitive material in which the degradation of the photographic properties is prevented when the photographic light-sensitive material contains an aldehyde gas scavenger in a sufficient amount for improving the resistivity to formaldehyde.

Other objects of the present invention will be apparent from the following detailed description and examples.

It has now been found that an unsubstituted or substituted glycoluril has an excellent capability of reacting with and fixing formaldehyde and without seriously affecting the photographic properties of the photographic light-sensitive material. The abovedescribed objects of the present invention are accomlished by adding a small amount of the compound to a layer of silver halide color photographic light-sensitive material.

DETAILED DESCRIPTION OF THE INVENTION

In one embodiment, the silver halide color photographic light-sensitive material of the present invention comprises a support having thereon at least one silver halide emulsion layer, wherein the silver halide color photographic light-sensitive layer contains an unsubstituted or substituted glycoluril.

The substituted glycoluril which can be used in the present invention includes glycoluril compounds which have an oil-soluble group, polymeric glycoluril compounds, and water-soluble low molecular weight glycoluril compounds.

Compounds which can be preferably used in the present invention are represented by the following general formula (I):

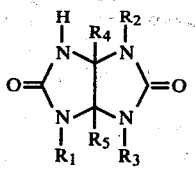

(I)

wherein $R_1$, $R_2$ and $R_3$, which may be the same or different, each represents a hydrogen atom, an alkyl group (for example, a methyl group, an ethyl group, an n-propyl group, an isopropyl group, an n-butyl group, a hydroxymethyl group, a 2-hydroxyethyl group, a methoxymethyl group, a chloromethyl group, a carboxymethyl group, a cyanoethyl group, etc.), an alkenyl group (for example, an allyl group, a 2-butenyl group, a 2-chloroallyl group, etc.), an aralkyl group (for example, a benzyl group, a phenethyl group, a p-methoxybenzyl group, etc.), an aryl group (for example, a phenyl group, a p-tolyl group, a p-methoxyphenyl group, an o-chlorophenyl group, an m-hydroxyphenyl group, etc.), or an acyl group (for example, an acetyl group, a propionyl group, a trifluoroacetyl group, a chloroacetyl group, an acryloyl group, a methacryloyl group, etc.); and $R_4$ and $R_5$, which may be the same or different, each represents a hydrogen atom or an alkyl group (examples of the alkyl group are same as those described for $R_1$ and $R_3$).

The glycoluril compounds used in the present invention include polymeric compounds in which a compound represented by the general formula (I) is bonded to a polymer chain (for example, a polyethylene chain, a polypropylene chain, etc.) through the group represented by $R_1$ or $R_3$. Further, in polymeric compounds, the group represented by $R_1$ or $R_3$ is bonded to the polymer chain through a connecting group such as $$-\underset{\underset{O}{\|}}{C}-,$$

—COO—, —CONH—, etc.

Specific examples of the compounds used in the present invention are set forth below, but the present invention is not to be construed as being limited thereto.

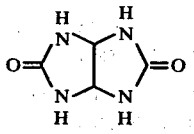

(1)

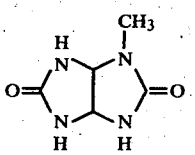

(2)

-continued

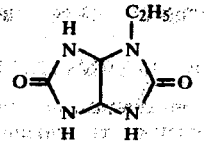

(3)

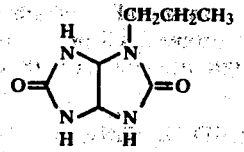

(4)

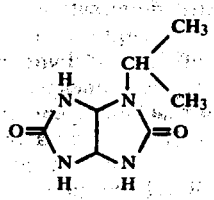

(5)

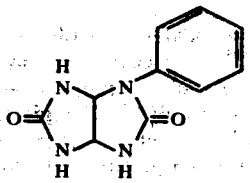

(6)

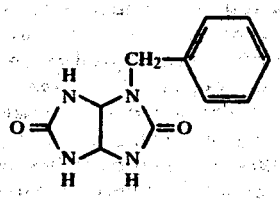

(7)

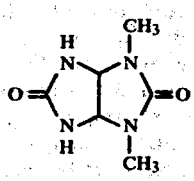

(8)

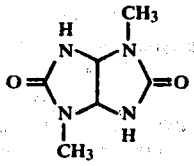

(9)

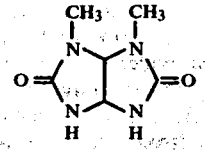

(10)

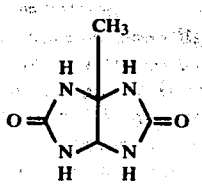

(11)

-continued
(12)
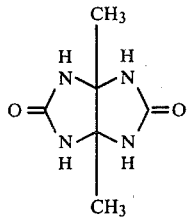
(13)
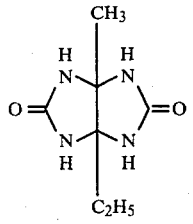
(14)
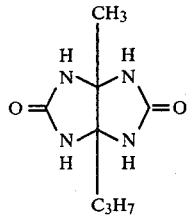
(15)
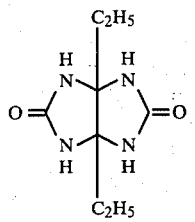
(16)
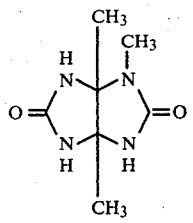
(17)
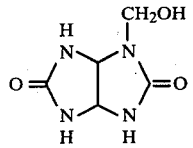
(18)
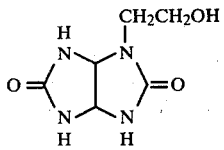
(19)
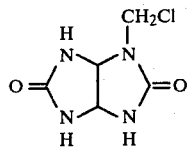
-continued
(20)
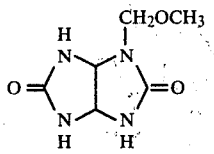
(21)
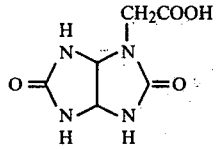
(22)
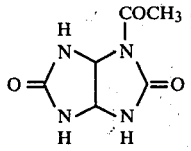
(23)
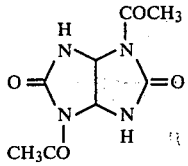
(24)
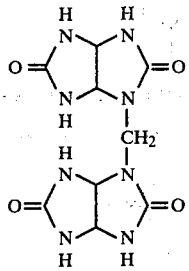
(25)
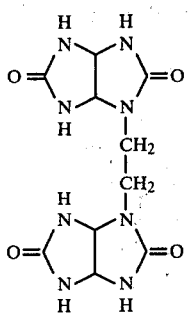
(26)
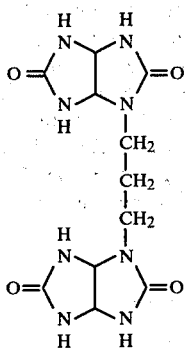

-continued

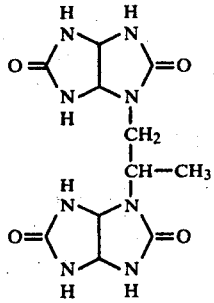

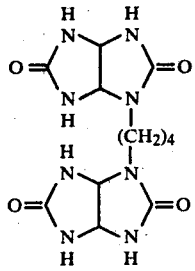

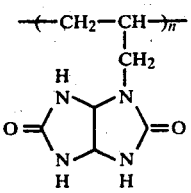

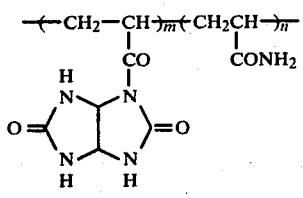

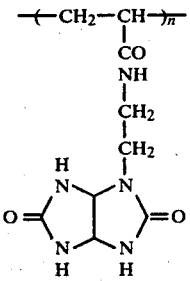

The compounds used in the present invention can be synthesized using urea or substituted urea and an α-diketo compound (for example, glyoxal, methyl glyoxal, diacetyl, etc.) in accordance with the method described in British Patent 717,287, U.S. Pat. Nos. 2,731,472 and 3,187,004, H. Pauly, *Chem. Ber.*, 63B, 2063 (1930), F. B. Slezak, *J. Org. Chem.*, 27, 2181 (1962), J. Nematollahi, *J. Org. Chem.*, 28, 2378 (1963), etc., in the following reaction scheme:

$$H_2N\overset{O}{\overset{\|}{C}}NHR_1 + R_4\overset{O}{\overset{\|}{C}}\overset{O}{\overset{\|}{C}}R_5 \longrightarrow$$

-continued (27)

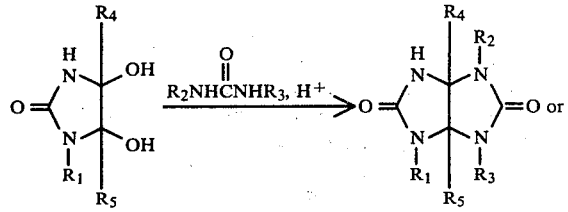

(28)

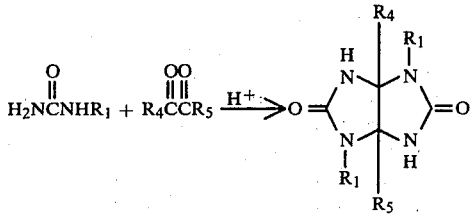

(29)

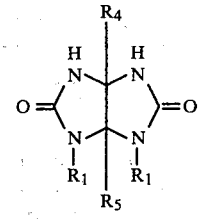

In the above formulae, $R_1$, $R_2$, $R_3$, $R_4$ and $R_5$ each has the same meaning as defined in the general formula (I).

Furthermore, by carrying out alkylation, acylation, hydroxymethylation, alkoxymethylation or halomethylation, etc., of glycoluril in a conventional manner, alkyl, acyl, hydroxymethyl, alkoxymethyl or halomethyl derivatives thereof can be obtained, respectively.

Specific synthesis examples of the compounds used in the present invention are set forth below.

SYNTHESIS EXAMPLE 1

Synthesis of Glycoluril [Compound (1)]

To 1,451 g (10.0 mols) of a 40% aqueous glyoxal solution adjusted to pH 7.0 was added 721 g (12.0 mols) of urea and the mixture was stirred at room temperature for 5 hours. About 900 ml of water was distilled off under reduced pressure, the crystals thus precipitated were collected by filtration and dried to obtain 768 g (yield: 65%) of 4,5-dihydroxy-2-imidazolidinone.

590 g (5 mols) of 4,5-dihydroxy-2-imidazolidinone and 300 g (5 mols) of urea were dissolved in 1 liter of water. 30 ml of concentrated hydrochloric acid was added to the solution and the mixture was stirred at 90° C. for 1 hour. After cooling, the crystals thus precipitated were collected by filtration, washed with water and dried to obtain 526 g (yield: 74%) of glycoluril. The melting point of glycoluril was above 300° C.

Elemental Analysis for $C_4H_6N_4O_2$: Calculated (%): H: 4.26, C: 33.81, N: 39.42, Found (%): H: 4.17, C: 33.64, N: 39.45.

SYNTHESIS EXAMPLE 2

Synthesis of 1-Methylglycoluril [Compound (2)]

118 g (1 mol) of 4,5-dihydroxy-2-imidazolidinone and 74 g (1 mol) of methylurea were dissolved in 100 ml of water. 5 ml of concentrated hydrochloric acid was added to the solution and the mixture was stirred at 90°

C. for 1 hour. After distilling off about 50 ml of water, 300 ml of methanol was added and the crystals were collected by filtration. The crystals were washed with methanol and dried to obtain 100 g (yield: 64%) of 1-methylglycoluril. The melting point of 1-methylglycoluril was 246° to 255° C. (dec.).

Elemental Analysis for $C_5H_8N_4O_2$: Calculated (%): H: 5.16, C: 38.46, N: 35.88, Found (%): H: 4.95, C: 38.21, N: 35.95.

SYNTHESIS EXAMPLE 3

Synthesis of 1,4-Dimethylglycoluril [Compound (9)] and 1,6-Dimethylglycoluril [Compound (10)]

To a mixture of 145 g (1 mol) of a 40% aqueous glyoxal solution and 148 g (2 mols) of methylurea was added 5 ml of concentrated hydrochloric acid. The mixture was reacted at 90° C. for 2 hours. After distilling off about 50 ml of water, 200 ml of methanol was added and the mixture was cooled to room temperature. The crystals were collected by filtration, washed with methanol and dried to obtain 100 g (yield: 59%) of a mixture of 1,4-dimethylglycoluril and 1,6-dimethylglycoluril. The melting point of the mixture was 228° to 236° C. (dec.).

Elemental Analysis for $C_6H_{10}N_4O_2$: Calculated (%): H: 5.92, C: 42.35, N: 32.92, Found (%): H: 5.80, C: 42.13, N: 32.94.

SYNTHESIS EXAMPLE 4

Synthesis of 3a-Methylglycoluril [Compound (11)]

90 g (0.5 mol) of a 40% aqueous methylglyoxal solution and 60 g (1 mol) of urea were dissolved to 100 ml of water. 5 ml of concentrated hydrochloric acid was added to the solution and the mixture was stirred at 90° C. for 2 hours. After cooling to room temperature, the crystals thus precipitated were collected by filtration, washed with water and dried to obtain 56 g (yield: 72%) of 3a-methylglycoluril. The melting point of 3a-methylglycoluril was 246° to 247.5° C. (dec.).

Elemental Analysis for $C_5H_8N_4O_2$: Calculated (%): H: 5.16, C: 38.46, N: 35.88, Found (%): H: 5.00, C: 38.37, N: 35.72.

SYNTHESIS EXAMPLE 5

Synthesis of 3a,6a-Dimethylglycoluril [Compound (12)]

Using 43 g (0.5 mol) of diacetyl in place of methylglyoxal, the same procedure as described in Synthesis Example 4 was conducted to obtain 71 g (yield: 84%) of 3a,6a-dimethylglycoluril. The melting point of 3a,6a-dimethylglycoluril was 330° C. (dec.).

Elemental Analysis for $C_6H_{10}N_4O_2$: Calculated (%): H: 5.92, C: 42.35, N: 32.92, Found (%): H: 5.81, C: 42.36, N: 32.74.

SYNTHESIS EXAMPLE 6

Synthesis of 1,1'-Ethylenediglycoluril [Compound (25)]

60 g (1 mol) of ethylenediamine and 120 g (2 mols) of urea were heated at 120° C. with stirring and the mixture was solidified after about 2 hours. The solid was recrystallized from a mixture of water and methanol to obtain 114 g (yield: 78%) of 1,1'-ethylenediurea.

73 g (0.5 mol) of 1,1'-ethylenediurea and 118 g (1 mol) of 4,5-dihydroxy-2-imidazolidinone were dissolved in 200 ml of water. 5 ml of concentrated hydrochloric acid was added to the solution and the mixture was stirred at 90° C. for 1 hour. After cooling to room temperature, the crystals were collected by filtration, washed with water and dried to obtain 105 g (yield: 68%) of 1,1'-ethylenediglycoluril. The melting point of 1,1'-ethylenediglycoluril was 235° to 245° C. (dec.).

Elemental Analysis for $C_{10}H_{14}N_8O_4$: Calculated (%): H: 4.55, C: 38.71, N: 36.11, Found (%): H: 4.32, C: 38.57, N: 36.02.

The aldehyde gas scavenger used in the present invention may be used as a mixture of two or more thereof. Further, the aldehyde gas scavenger may be used together with other known aldehyde gas scavengers, for example, noncyclic ureas such as urea, biuret, 1,1'-ethylenediurea, etc., cyclic ureas such as ethyleneurea, barbituric acid, urazol, parabanic acid, hydantoin, allantoin, etc., active methylene compounds such as dimedone, cyano acetic acid, malonic acid, etc.

The aldehyde gas scavenger used in the present invention can be incorporated into at least one layer of a silver halide color photographic light-sensitive material, such as a silver halide emulsion layer, a subbing layer, a protective layer, an intermediate layer, a filter layer, an antihalation layer and other auxiliary layers. However, it is more effective to incorporate the compound into a silver halide emulsion layer, the photographic properties of which are degraded when they come in contact with harmful gas such as formaldehyde gas, etc.; or a layer which is positioned closer to the air than the silver halide emulsion layer such as a protective layer, etc.

In order to incorporate the aldehyde gas scavenger used in the present invention into the photographic layer, the compound can be added to a coating solution for the layer directly or by dissolving it in a solvent which does not adversely affect the silver halide color photographic light-sensitive material, for example, water, an alcohol, etc., in an appropriate concentration. Also, the aldehyde gas scavenger can be added by dissolving the compound in a high boiling point organic solvent and/or a low boiling point organic solvent and dispersing the solution in an aqueous solution. The aldehyde gas scavenger can be added at any time during the production of the color photographic light-sensitive material. However, it is generally desirable that the compound is added just before coating. Generally, the aldehyde gas scavenger is added in an amount of from 0.01 g to 10 g, and preferably from 0.05 to 5 g, per square meter of the silver halide color photographic light-sensitive material.

The photographic emulsion layers in the photographic light-sensitive material of the present invention may contain color forming couplers, namely, compounds capable of color forming by an oxidation coupling reaction with the aromatic primary amine developing agent (for example, phenylenediamine derivatives, aminophenol derivatives, etc.) in the color development processing. For example, magenta couplers such as 5-pyrazolone couplers, pyrazolobenzimidazole couplers, cyanoacetyl coumarone couplers, ring-opened acylacetonitrile couplers, etc.; yellow couplers such as acylacetamide couplers (for example, benzoylacetanilides and pivaloylacetanilides), etc.; and cyan couplers such as naphthol couplers, phenol couplers, etc. It is preferred that these couplers have a hydrophobic group which is called a ballast group in the molecule, or are non-diffusible due to their polymeric structure. The couplers may be 2-equivalent or 4-equivalent to silver ion. Further, the couplers may be colored couplers having a function of color correction or couplers which release a development inhibitor with development (the so-called DIR couplers).

Further, the emulsion layers may contain non-color forming DIR coupling compounds other than DIR couplers which release a development inhibitor, the product of which, formed by a coupling reaction, is colorless.

The emulsion layers may contain non-color forming couplers, the product of which, formed by a coupling reaction, is colorless; infrared couplers which form a dye having an infrared absorption by a coupling reaction; and black color forming couplers which form black images by a coupling reaction, etc., other than the above described couplers. Furthermore, the emulsion layers may contain couplers which release a development accelerator with development as described in Japanese Patent Application (OPI) No. 150845/82 (the term "OPI" as used herein refers to a "published unexamined Japanese patent application").

Specific examples of the magenta couplers include those described in U.S. Pat. Nos. 2,600,788, 2,983,608, 3,062,653, 3,127,267, 3,311,476, 3,419,391, 3,519,429, 3,558,319, 3,582,322, 3,615,506, 3,834,908, 3,891,445, 3,926,631, 3,928,044, 4,076,533, 4,189,321, 4,220,470, 4,264,723 and 4,248,961, German Pat. No. 1,810,464, German Patent Application (OLS) Nos. 2,408,665, 2,417,945, 2,418,959, 2,424,467, 2,536,191, 2,651,363, 2,935,848 and 2,944,601, Japanese Patent Publication Nos. 6031/65, 38498/79, 10901/80, 29420/80 and 29421/80, and Japanese Patent Application (OPI) Nos. 74027/74, 129538/74, 60233/75, 159336/75, 20826/76, 26541/76, 36938/76, 105820/76, 42121/77, 58922/77, 9122/78, 55122/78, 48540/79, 80744/79, 62454/80, 118034/80, 38043/81, 38044/81 and 75648/81, Japanese Patent Application (OPI) Nos. 126833/81 and 17950/82, etc.

Specific examples of the yellow couplers include those described in U.S. Pat. Nos. 2,875,057, 3,265,506, 3,408,194, 3,551,155, 3,582,322, 3,725,072, 3,891,445, 3,894,875, 3,973,968, 3,990,896, 4,008,086, 4,012,259, 4,022,620, 4,029,508, 4,046,575, 4,057,432, 4,059,447, 4,095,983, 4,133,958, 4,157,919, 4,182,630, 4,186,019, 4,203,768, 4,206,278 and 4,266,019, German Pat. No. 1,547,868, German Patent Application (OLS) Nos. 2,213,461, 2,219,917, 2,261,361, 2,263,875, 2,414,006, 2,528,638, 2,935,849 and 2,936,842, British Pat. No. 1,425,020, Japanese Patent Publication Nos. 13576/74, 10783/76, 36856/79 and 13023/80, Japanese Patent Application (OPI) Nos. 26133/72, 66835/73, 6341/75, 34232/75, 87650/75, 130442/75, 75521/76, 102636/76, 145319/76, 21827/76, 82424/77, 115219/77, 48541/79, 121126/79, 2300/80, 36900/80, 38576/80, 70841/80, 161239/80 and 87041/81, *Research Disclosure*, No. 18053, etc.

Specific examples of the cyan couplers include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,758,308, 3,767,411, 4,004,929, 4,052,212, 4,124,396, 4,146,396, 4,205,990, 4,228,233, 4,254,212 and 4,264,722, German Patent Application (OLS) Nos. 2,214,489, 2,414,830, 2,454,329, 2,634,694, 2,841,166, 2,934,769, 2,945,813, 2,947,707 and 3,005,355, Japanese Patent Publication Nos. 37822/79 and 37823/79, and Japanese Patent Application (OPI) Nos. 5055/73, 59838/73, 130441/75, 26034/76, 146828/76, 69624/77, 90932/77, 52423/78, 105226/78, 110530/78, 14736/79, 48237/79, 66129/79, 131931/79, 32071/80, 65957/80, 73050/80, 108662/80, 1938/81, 12643/81, 55945/81, 65134/81 and 80045/81, etc.

Specific examples of the colored couplers include those described in U.S. Pat. Nos. 2,521,908, 3,034,892 and 3,476,560, German Patent Application (OLS) No. 2,418,959, Japanese Patent Publication Nos. 22335/63, 11304/67, 2016/69 and 32461/69, and Japanese Patent Application (OPI) Nos. 26034/76, 42121/77, etc.

Specific examples of the DIR couplers include those described in U.S. Pat. Nos. 3,227,554, 3,617,291, 3,632,345, 3,701,783, 3,790,384, 3,933,500, 3,938,996, 4,052,213, 4,157,916, 4,171,223, 4,183,752, 4,187,110 and 4,226,934, German Patent Application (OLS) Nos. 2,414,006, 2,454,301, 2,454,329, 2,540,959, 2,707,489, 2,709,688, 2,730,824, 2,754,281, 2,835,073, 2,853,363, 2,855,697 and 2,902,681, British Pat. No. 953,454, Japanese Patent Publication Nos. 16141/76, 2776/78, 34933/80 and 47379/80, Japanese Patent Application (OPI) Nos. 122335/74, 69624/77, 154631/77, 7232/78, 9116/78, 15136/78, 20324/78, 29717/78, 13533/78, 143223/79, 73033/79, 114241/79, 115229/79, 145135/79, 84935/80 and 135835/80, Japanese Patent Application No. 37374/81, *Research Disclosure*, No. 18104, etc.

In addition to DIR couplers, the light-sensitive materials may contain compounds which release a development inhibitor with development, specific examples of which include those described in U.S. Pat. Nos. 3,297,445 and 3,379,529, German Patent Application (OLS) No. 2,417,914, Japanese Patent Application (OPI) Nos. 15271/77 and 9116/78, etc.

Specific examples of the non-color forming couplers include those described in U.S. Pat. Nos. 3,912,513 and 4,204,867, Japanese Patent Application (OPI) No. 152721/77, etc.

Specific examples of the infrared couplers include those described in U.S. Pat. No. 4,178,183, Japanese Patent Application (OPI) No. 129036/78, and *Research Disclosure*, No. 13460 and No. 18732, etc.

Specific examples of the black color forming couplers include those described in U.S. Pat. Nos. 4,126,461, 4,137,080 and 4,200,466, Japanese Patent Application (OPI) Nos. 46029/78, 133432/78, 105247/80 and 105248/80, etc.

The emulsion layers in the photographic light-sensitive materials of the present invention may contain polymeric couplers. Specific examples of these couplers include those described in U.S. Pat. Nos. 2,698,797, 2,759,816, 2,852,381, 3,163,625, 3,208,977, 3,211,552, 3,299,013, 3,370,952, 3,424,583, 3,451,820, 3,515,557, 3,767,412, 3,912,513, 3,926,436, 4,080,211, 4,128,427 and 4,215,195, *Research Disclosure*, No. 17825, No. 18815 and No. 19033, etc.

It has been found that the compound according to the present invention exhibits particularly remarkable improved effects in the photographic light-sensitive material containing a 4-equivalent magenta coupler.

The 4-equivalent magenta couplers which can be preferably used in the present invention include not only the so-called oil-soluble magenta couplers containing a hydrophobic group but also the so-called Fisher type magenta couplers containing both a hydrophobic group and a hydrophilic group and magenta polymer coupler latexes described hereinafter.

Specific examples of the oil-soluble magenta couplers are set forth below, but the present invention is not to be construed as being limited thereto.

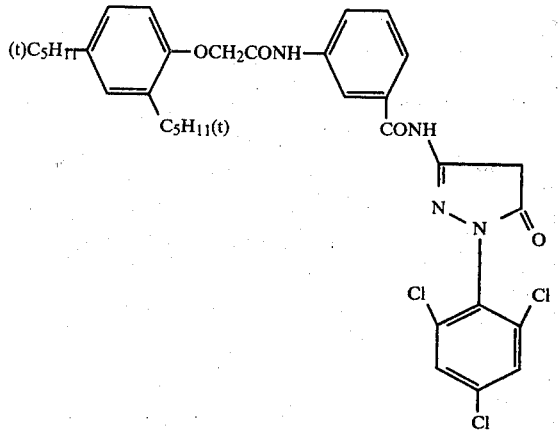
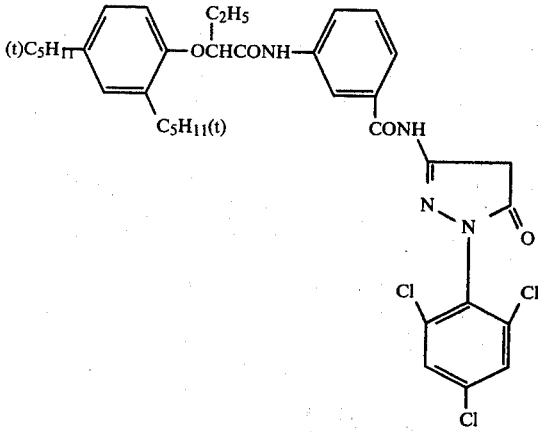
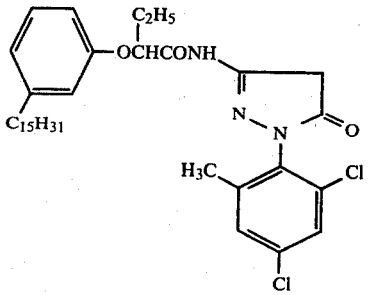
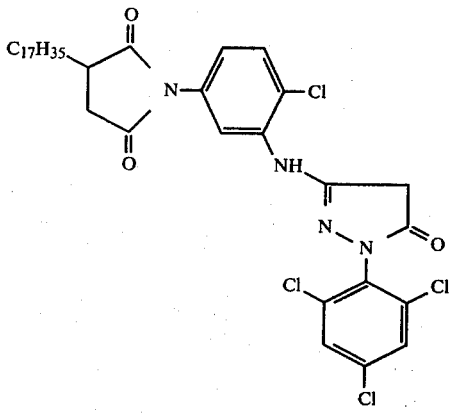
-continued
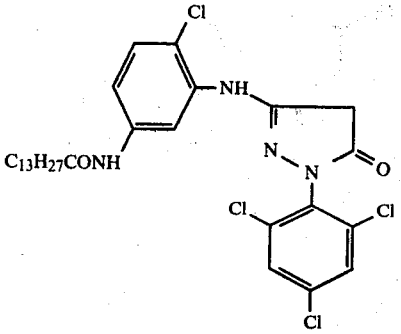
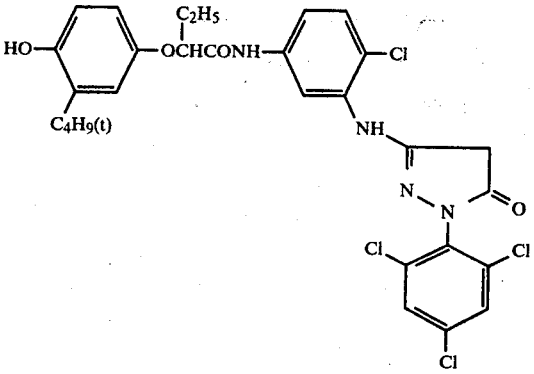
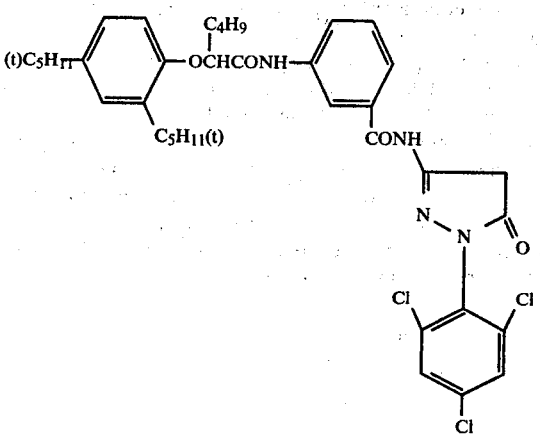
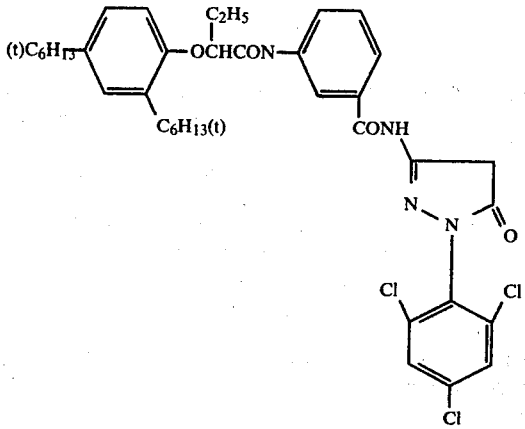

-continued

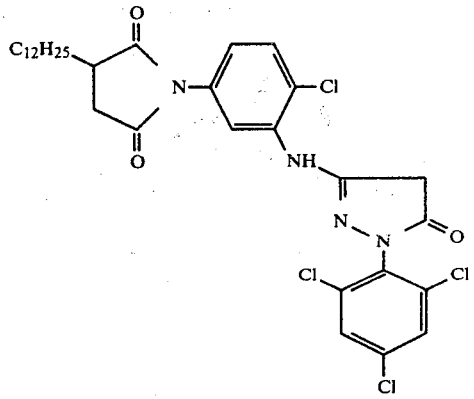

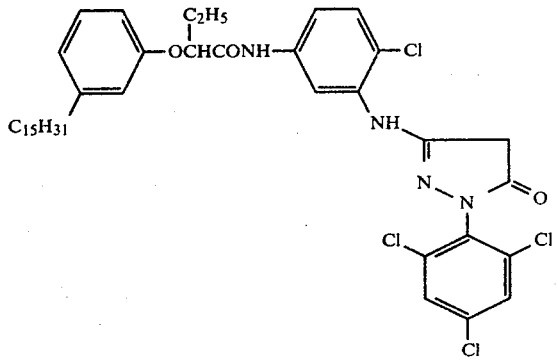

The 4-equivalent magenta color image forming polymer coupler latex which can be used in the present invention is preferably a polymer having a repeating unit derived from a monomer coupler represented by the general formula (II) described below, or a copolymer of a repeating unit derived from a monomer coupler represented by the general formula (II) described below and at least one non-color forming monomer having at least one ethylene group which does not have the ability to carry out oxidative coupling with an aromatic primary amine developing agent.

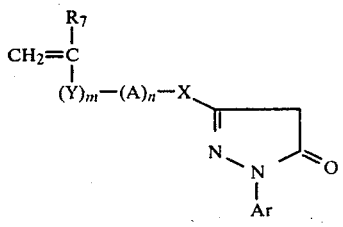

(II)

wherein $R_7$ represents a hydrogen atom, a lower alkyl group containing from 1 to 4 carbon atoms or a chlorine atom; X represents —CONH—, —NH—, —NHCONH— or —NHCOO—; Y represents —CONH— or —COO—; A represents a divalent connecting group which is composed from one or more groups selected from an alkylene group having from 1 to 10 carbon atoms which may be substituted, an alkenylene group which may be substituted, a phenylene group which may be substituted, —O—, —S—, —SO—, —$SO_2$—, —CO—, —NH—, —CONH— or —COO—. The alkylene group and the alkenylene group may be a straight chain or a branched chain. For example, a methylene group, a methylmethylene group, a dimethylmethylene group, a dimethylene group, a trimethylene group, a pentamethylene group, a decamethylene group, etc.

Substituents for the alkylene group, the alkenylene group or the phenylene group represented by A include an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), a sulfonyl group (for example, a methylsulfonyl group, etc.), and the like. When two or more substituents are present, they may be the same or different.

Ar represents an unsubstituted or substituted phenyl group. Substituents for the phenyl group include an alkyl group (for example, a methyl group, an ethyl group, etc.), an alkoxy group (for example, a methoxy group, an ethoxy group, etc.), an aryloxy group (for example, a phenoxy group, etc.), an alkoxycarbonyl group (for example, a methoxycarbonyl group, etc.), an acylamino group (for example, an acetylamino group, etc.), a carbamoyl group, an alkylcarbamoyl group (for example, a methylcarbamoyl group, an ethylcarbamoyl group, etc.), a dialkylcarbamoyl group (for example, a dimethylcarbamoyl group, etc.), an arylcarbamoyl group (for example, a phenylcarbamoyl group, etc.) an alkylsulfonyl group (for example, a methylsulfonyl group, etc.), an arylsulfonyl group (for example, a phenylsulfonyl group, etc.), an alkylsulfonamido group (for example, a methanesulfonamido group , etc.), an arylsulfonamido group (for example, a phenylsulfonamido group, etc.), a sulfamoyl group, an alkylsulfamoyl group (for example, an ethylsulfamoyl group, etc.), a dialkylsulfamoyl group (for example, a dimethylsulfamoyl group, etc.), an alkylthio group (for example, a methylthio group, etc.), an arylthio group (for example, a phenylthio group, etc.), a cyano group, a nitro group, a halogen atom (for example, a fluorine atom, a chlorine atom, a bromine atom, etc.), and the like. When two or more substituents are present, they may be the same or different.

Particularly preferred substituents include a halogen atom, an alkyl group, an alkoxy group, an alkoxycarbonyl group and a cyano group.

m represents 0 or 1, and n represents 0 or 1.

Examples of the non-color forming monomer which does not couple with the oxidation product of an aromatic primary amine developing agent include an ester, preferably a lower alkyl ester and an amide, derived from an acrylic acid (for example, acrylic acid, α-chloroacrylic acid, α-alkylacrylic acid such as methacrylic acid), for example, acrylamide, methacrylamide, t-butylacrylamide, methyl acrylate, ethyl acrylate, n-propyl acrylate, n-butyl acrylate, 2-ethylhexyl acrylate, n-hexyl acrylate, octyl methacrylate, lauryl methacrylate, methylene bisacrylamide, etc., a vinyl ester, for example, vinyl acetate, vinyl propionate, vinyl laurate, etc., acrylonitrile, methacrylonitrile, an aromatic vinyl compound, for example, styrene and a derivative thereof, for example, vinyl toluene, divinyl benzene, vinyl acetophenone, sulfo styrene, etc., itaconic acid, citraconic acid, crotonic acid, vinylidene chloride, a vinyl alkyl ether, for example, vinyl ethyl ether, an ester of maleic acid, N-vinyl-2-pyrrolidone, N-vinyl pyridine, 2- or 4-vinyl pyridine, etc.

Of these monomers, an ester of acrylic acid, an ester of methacrylic acid and an ester of maleic acid are particularly preferred.

Two or more comonomer compounds described above can be used together. For example, a combination of n-butyl acrylate and divinyl benzene, styrene and methacrylic acid, n-butyl acrylate and methacrylic acid, etc., can be used.

The ethylenically unsaturated monomer which is used to copolymerize with the monomer coupler represented by the above-described general formula (II) can be selected so that the copolymer to be formed possesses good physical properties and/or chemical properties, for example, solubility, compatibility with a binder such as gelatin in a photographic colloid composition, flexibility, heat stability, etc., and other well known properties in the field of polymer color couplers.

The magenta polymer coupler latex used in the present invention can be prepared by dissolving a lipophilic polymer coupler obtained by the polymerization of a monomer coupler in an organic solvent and then dispersing the solution in a latex form in an aqueous gelatin solution. This can be accomplished by directly dispersing a solution of a lipophilic polymer coupler obtained by the polymerization of a monomer coupler or by dissolving a solid lipophilic polymer coupler once collected in an organic solvent and then dispersing the solution in a latex form. Alternatively, a latex prepared by an emulsion polymerization method may be directly added to a gelatin silver halide emulsion.

With respect to the former case in which a lipophilic polymer coupler is dispersed in a latex form in an aqueous gelatin solution, the method as described in U.S. Pat. No. 3,451,820 can be used. With respect to the latter case in which a latex prepared by an emulsion polymerization method is directly added, the method as described in U.S. Pat. Nos. 4,080,211, 3,370,952, 3,926,436 and 3,767,412, and British Pat. No. 1,247,688 can be used.

These methods can be applied to a preparation of homopolymers and a preparation of copolymers. In the latter case, a non-color forming comonomer is preferably a liquid comonomer which may act, in the case of the emulsion polymerization, as a solvent for a monomer which is solid in its normal state.

The organic solvent which is used for dissolving a lipophilic polymer coupler when the lipophilic polymer coupler is dispersed in a latex form in an aqueous gelatin solution is removed from the mixture before coating with the dispersion solution. The solvent may also be removed by vaporization during drying of the dispersion solution coated, although this process is less preferable. With respect to removing the solvent, a method in which the solvent is removed by washing a gelatin noodle with water is used when the solvent is water-soluble to some extent, or a spray drying method, a vacuum purging method or a steam purging method can be employed for removing the solvent.

Examples of the organic solvents which can be removed include, for example, an ester (for example, a lower alkyl ester, etc.), a lower alkyl ether, ketone, halogenated hydrocarbon (for example, methylene chloride, trichloroethylene, a fluorinated hydrocarbon, etc.), an alcohol (for example, an alcohol between n-butyl alcohol and octyl alcohol, etc.), and a mixture thereof.

Any type of dispersing agent can be used in the dispersion of the lipophilic polymer coupler. Ionic surface active agents, and particularly anionic surface active agents, are preferred. Amphoteric surface active agents such as C-cetyl betaine, an N-alkylaminopropionate, an N-alkyliminodipropionate, etc., can also be used.

The emulsifier used in the emulsion polymerization is a compound having surface activity. Preferred examples include soap, a sulfonate, a sulfate, a cationic compound, an amphoteric compound and a high molecular weight protective colloid. Specific examples and functions of the emulsifiers are described in *Belgische Chemische Industrie*, Vol. 28, pages 16 to 20 (1963).

In order to increase the dispersion stability, control the color hue of a dye formed from a polymer coupler latex dispersed and the oxidation product of an aromatic primary amine developing agent and improve the bending property of the emulsion coated, a permanent solvent, that is, a water-immiscible organic solvent having a high boiling point (i.e., above 200° C.), may be added in a small amount (i.e., not more than 50% by weight based on the polymer coupler). The concentration of the permanent solvent must be at such a low level that the copolymer is plasticized while it is maintained in solid particle form. Furthermore, it is desirable to use the permanent solvent in a relatively low concentration in order to reduce the thickness of the final emulsion layer as much as possible to obtain good sharpness.

It is desirable if the ratio of the color forming portion in the polymer coupler latex is usually from 5 to 80% by weight. Particularly, a ratio from 20 to 70% by weight is preferred in view of color reproducibility, color forming property and stability. In this case, an equivalent molecular weight, that is, a gram number of the polymer containing 1 mol of a coupler monomer is preferably from about 250 to 3,000, but it is not limited thereto.

Preferred specific examples of the monomer couplers used in the present invention are set forth below, but the present invention is not to be construed as being limited thereto.

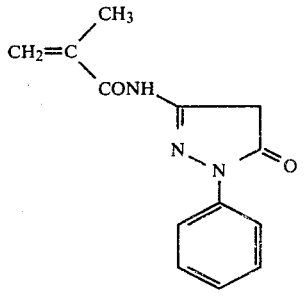

-continued
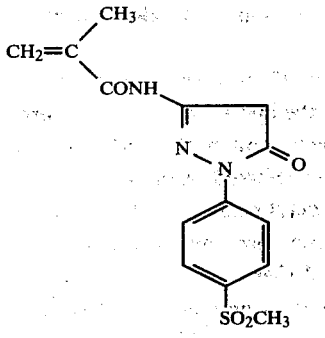
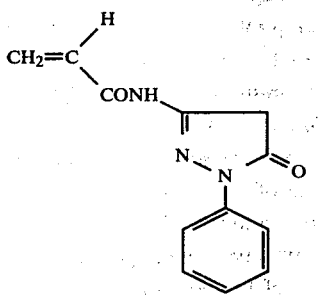
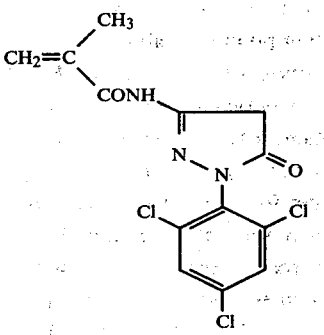
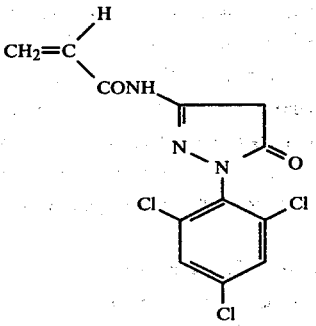
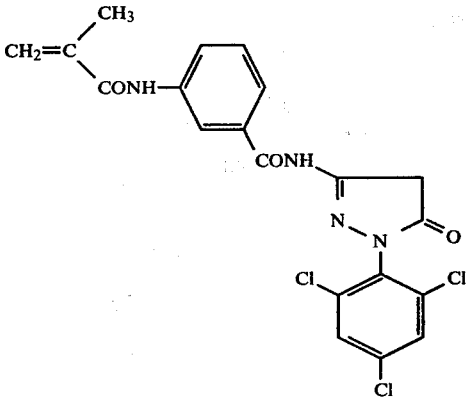
-continued
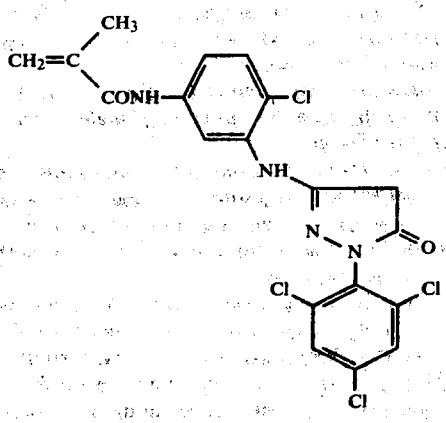
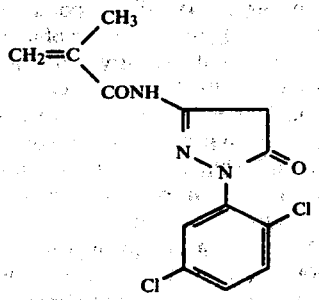
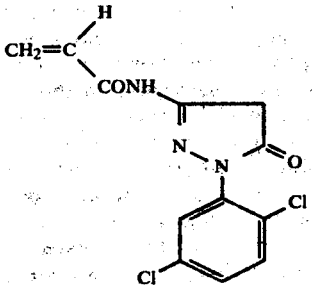
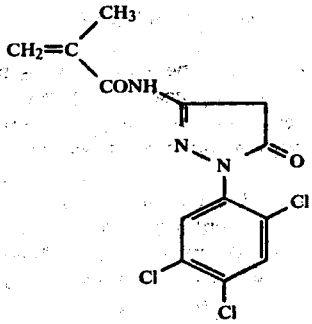
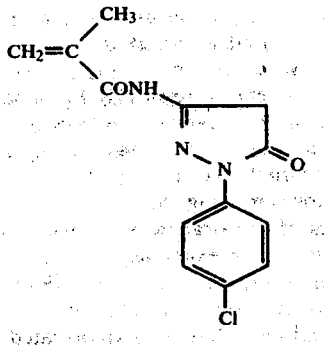

-continued
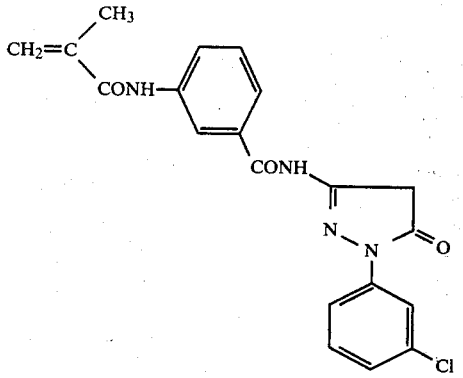
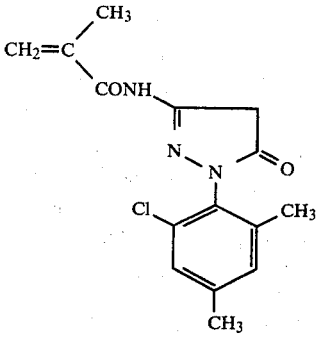
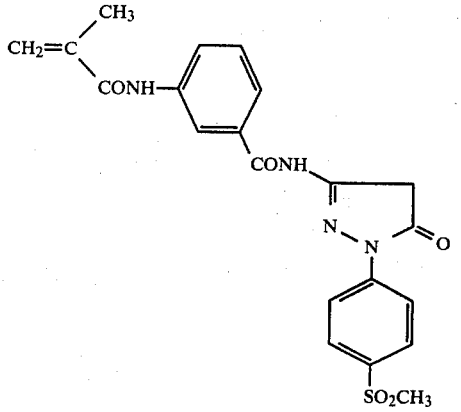
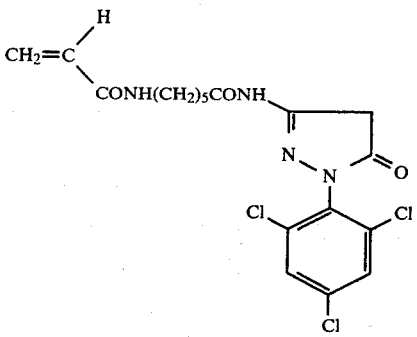
-continued
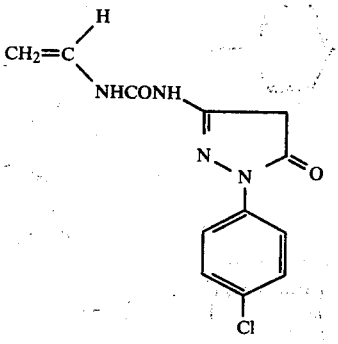
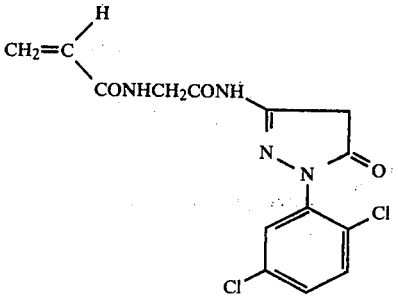
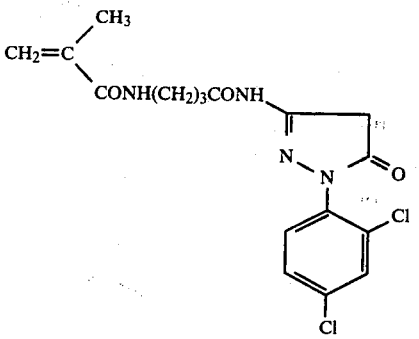
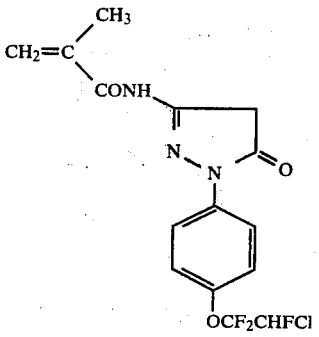
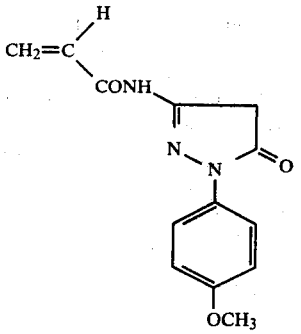

-continued

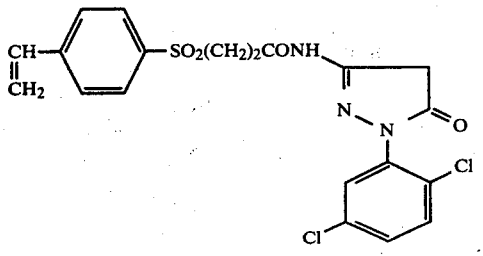

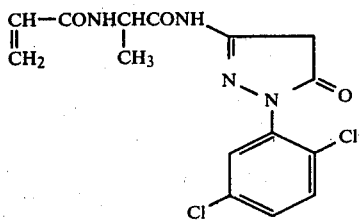

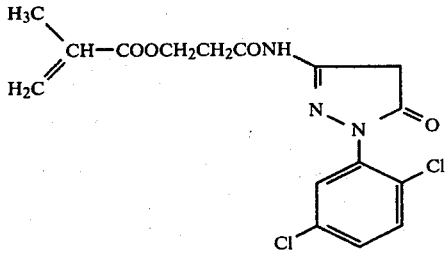

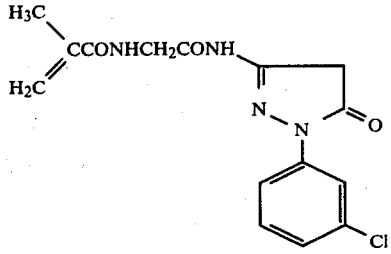

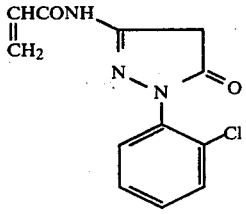

In the photographic light-sensitive materials of the present invention, the photographic emulsion layers and other layers are applied to flexible supports such as plastic films, paper, cloth, etc., or rigid supports such as glass, ceramics, metal, etc., which are conventionally used for photographic light-sensitive materials. Examples of useful flexible supports include films composed of semi-synthetic or synthetic high molecular materials such as cellulose nitrate, cellulose acetate, cellulose acetate butyrate, polystyrene, polyvinyl chloride, polyethylene terephthalate, polycarbonate, etc., and papers coated or laminated with baryta, α-olefin polymers (for example, polyethylene, polypropylene or ethylene/butene copolymer), etc. The supports may be colored by dyes or pigments. They also may have a black color for the purpose of light-shielding. The surface of these supports is generally subjected to an undercoating treatment in order to improve adhesion to the photographic emulsion layer, etc. The surface of the supports may be subjected to corona discharging, ultraviolet ray application, flame treatment, etc., prior to or after the undercoating treatment.

The present invention can be applied to multilayer multicolor photographic materials having at least two different spectral sensitivities. The multilayer technicolor photographic materials have generally at least one red-sensitive emulsion layer, at least one green-sensitive emulsion layer and at least one blue-sensitive emulsion layer on the base. The order of superposition of these layers can be suitably varied. Ordinarily, the red-sensitive emulsion layer contains a cyan coupler, the green-sensitive emulsion layer contains a magenta coupler and the blue-sensitive emulsion layer contains a yellow coupler. However, if necessary, other combinations may be utilized.

In carrying out the preparation of the emulsions, removal of soluble salts from the emulsions after precipitation or physical aging may be carried out by a noodle washing method in which gelatin is gelated, or by a flocculation method utilizing inorganic salts, anionic surface active agents, anionic polymers (for example, polystyrenesulfonic acid), or gelatin derivatives (for example, acylated gelatin, carbamoylated gelatin, etc.).

The silver halide emulsions are generally chemically sensitized. In order to carry out chemical sensitization, it is possible to use processes as described in *Die Grundlagen der Photographischen Prozesse mit Silberhalogeniden,* edited by H. Frieser (Akademische Verlagsgesellschaft, 1968), pages 675–734.

Namely, it is possible to use a sulfur sensitization process which comprises using sulfur containing compounds capable of reacting with active gelatin and silver (for example, thiosulfates, thioureas, mercapto compounds or rhodanines), a reduction sensitization process which comprises using reducing substances (for example, stannous salts, amines, hydrazine derivatives, formamidinesulfinic acid and silane compounds) and a noble metal sensitization process which comprises using noble metal compounds (for example, gold complex salts and complex salts of metals belonging to Group VIII in the Periodic Table, such as Pt, Ir, Pd, etc.), which may be used alone or as a combination thereof.

Examples of the sulfur sensitization process have been described in U.S. Pat. Nos. 1,574,944, 2,410,689, 2,278,947, 2,728,668 and 3,656,955, those of the reduction sensitization process have been described in U.S. Pat. Nos. 2,983,609, 2,419,974 and 4,054,458. Further, examples of the noble metal sensitization process have been described in U.S. Pat. Nos. 2,399,083 and 2,448,060 and British Pat. No. 618,061, etc.

As the binder or the protective colloid for the photographic emulsions of the photographic light-sensitive materials of the present invention, gelatin is advantageously used, but other hydrophilic colloids can also be used.

For example, it is possible to use proteins such as gelatin derivatives, graft polymers of gelatin and other high molecules, albumin, casein, etc.; saccharides such as cellulose derivatives such as hydroxyethyl cellulose, carboxymethyl cellulose, cellulose sulfate, etc.; sodium alginate; starch derivatives; and various synthetic hydrophilic high molecular substances such as homopolymers or copolymers, for example, polyvinyl alcohol, polyvinyl alcohol hemiacetal, poly-N-vinylpyrrolidone, polyacrylic acid, polymethacrylic acid, polyacrylamide, polyvinylimidazole, polyvinylpyrazole, etc.

As gelatin, not only lime-processed gelatin, but also acid-processed gelatin and enzyme-processed gelatin described in *Bull. Soc. Sci. Phot.* Japan, No. 16, page 30 (1966) may be used. Further, hydrolyzed products or enzymatic products of gelatin can also be used. As the gelatin derivatives, it is possible to use those prepared by reacting gelatin with various compounds, for example, acid halides, acid anhydrides, isocyanates, bromoacetic acid, alkanesultones, vinylsulfonamides, maleinimide compounds, polyalkylene oxides, epoxy compounds, etc. Examples have been described in U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc.

As the above described gelatin graft polymers, it is possible to use those obtained by grafting homo- or copolymers of vinyl monomers such as acrylic acid, methacrylic acid, or derivatives thereof such as esters, amides, etc., acrylonitrile, styrene, etc., on gelatin. It is particularly preferred to use graft polymers composed of gelatin and polymers which have a certain degree of compatibility with gelatin, such as polymers of acrylic acid, methacrylic acid, acrylamide, methacrylamide, hydroxyalkyl methacrylate, etc. Examples of these have been described in U.S. Pat. Nos. 2,763,625, 2,831,767, 2,956,884, etc.

Examples of typical synthetic hydrophilic high molecular substances include those described in German Patent Application (OLS) No. 2,312,708, U.S. Pat. Nos. 3,620,751 and 3,879,205, and Japanese Patent Publication No. 7561/68.

Further, in the photographic light-sensitive materials of the present invention, it is possible to add dispersions of water-insoluble or sparingly soluble synthetic polymers to photographic emulsion layers and other hydrophilic colloid layers in order to improve the dimensional stability. For example, it is possible to use polymers composed of one or more monomers selected from alkyl acrylates, alkyl methacrylates, alkoxyalkyl acrylates, alkoxyalkyl methacrylates, glycidyl acrylates, glycidyl methacrylates, acrylamide, methacrylamide, vinyl esters (for example, vinyl acetate), acrylonitrile, olefins, styrene, etc., and polymers composed of a combination of the above described monomers and acrylic acid, methacrylic acid, $\alpha,\beta$-unsaturated dicarboxylic acid, hydroxyalkyl acrylate, hydroxyalkyl methacrylate, sulfoalkyl acrylate, sulfoalkyl methacrylate, styrene-sulfonic acid, etc. Examples of these include those described in U.S. Pat. Nos. 2,376,005, 2,739,137, 2,853,457, 3,062,674, 3,411,911, 3,488,708, 3,525,620, 3,607,290, 3,635,715, 3,645,740 and British Pat. Nos. 1,186,699 and 1,307,373.

In the light-sensitive materials of the present invention, the hydrophilic colloid layers may be mordanted by cationic polymers if they contain dyes or ultraviolet ray absorbing agents. For example, it is possible to use polymers described in British Pat. No. 685,475, U.S. Pat. Nos. 2,675,316, 2,839,401, 2,882,156, 3,048,487, 3,184,309 and 3,445,231, German Patent Application (OLS) No. 1,914,362 and Japanese Patent Application (OPI) Nos. 47624/75 and 71332/75.

In the photographic light-sensitive materials of the present invention, the photographic emulsion layers and other hydrophilic colloid layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-divinylsulfonyl-2-propanol, 1,2-di(vinylsulfonylacetamido)ethane, 1,3-di(vinylsulfonylacetamido)propane, bis(vinylsulfonylmethyl)ether, 1,3-divinylsulfonylpropane, 1,2-divinylsulfonylethane, 1,3,5-trivinylsulfonylhexahydro-s-triazine, etc.), active halogen compounds (2,4-dichloro-6-hydroxy-s-triazine, etc.), and mucohalogenic acids (mucochloric acid, mucophenoxychloric acid, etc.), which are used alone or as a combination thereof.

The photographic emulsion layers and other hydrophilic colloid layers in the light-sensitive materials of the present invention may contain surface active agents for various purposes, for example, as coating assistants, or for prevention of electrical charging, improvement of lubricating property, emulsification, prevention of adhesion, improvement of photographic properties (for example, acceleration of development, hard tone or sensitization), etc.

It is possible to use nonionic surface active agents such as saponin (steroid), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyethylene glycol alkylamines or amides, polyethylene oxide adducts of silicone, etc.), glycidol derivatives (for example, alkenylsuccinic acid polyglycerides and alkylphenol polyglycerides), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic sulfonium salts, aliphatic or heterocyclic phosphonium salts, etc. In addition, fluorine containing surface active agents may be used.

In the photographic emulsion layers of the photographic light-sensitive materials of the present invention, any of silver bromide, silver iodobromide, silver iodochlorobromide, silver chlorobromide and silver chloride may be used as the silver halide. Preferred silver halide is silver iodobromide.

The photographic emulsions used in the present invention may be spectrally sensitized by methine dyes or others. Although these sensitizing dyes can be used alone, they may be used as a combination of two or more of them. The combination of the sensitizing dyes is often used for the purpose of supersensitization. The emulsions may contain dyes which do not have a spectral sensitization function themselves or substances which do not substantially absorb visible rays and show supersensitization, together with the sensitizing dyes.

Suitable sensitizing dyes, combinations of dyes which show supersensitization and subtances which show supersensitization have been described in *Research Disclosure,* Vol. 176, No. 17643 (December, 1978), page 23 IV-J.

In the light-sensitive materials of the present invention, the hydrophilic colloid layers may contain water-soluble dyes as filter dyes or for the purpose of preventing irradiation or for other purposes. Examples of such dyes include oxonol dyes, hemioxonol dyes, styryl dyes, merocyanine dyes, cyanine dyes and azo dyes. Particularly, oxonol dyes, hemioxonol dyes and merocyanine dyes are useful.

For the purpose of increasing sensitivity, increasing contrast or accelerating development, the photographic emulsion layers of the photographic light-sensitive materials of the present invention may contain, for example, polyalkylene oxide or derivatives thereof such as ethers, esters, amines, etc., thioether compounds, thiomorpholines, quaternary ammonium compounds, urethane derivatives, urea derivatives, imidazole derivatives, 3-pyrazolidones, etc. For example, it is possible to use those described in U.S. Pat. Nos. 2,400,532, 2,423,549, 2,716,062, 3,617,280, 3,772,021 and 3,808,003, British Pat. No. 1,488,991, etc.

In the photographic emulsions used in the present invention, it is possible to incorporate various compounds for the purpose of preventing fogging in the production of the light-sensitive materials, during preservation thereof or during photographic processing or for the purpose of stabilizing photographic properties. For example, it is possible to add various known antifogging agents or stabilizers such as azoles, for example, benzothiazolium salts, nitroimidazoles, triazoles, benzotriazoles or benzimidazoles (particularly, nitro- or halogen substituted benzimidazoles); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) or mercaptopyrimidines; the above described heterocyclic mercapto compounds having water-soluble groups such as a carboxyl group, a sulfo group, etc.; thioketo compounds, for example, oxazolinethione; azaindenes, for example, tetraazaindenes (particularly, 4-hydroxy-(1,3,3a,7)-tetraazaindenes); benzenethiosulfonic acids; benzenesulfinic acids, gallic acid derivatives as described in Japanese Patent Application No. 116167/81, etc.

The light-sensitive materials of the present invention may contain hydroquinone derivatives, aminophenol derivatives, gallic acid derivatives, ascorbic acid derivatives, etc., as anti-color-fogging agents.

In carrying out the present invention, known anti-fading agents can be used together. Further, the dye image stabilizers used in the present invention can be used alone or as a mixture of two or more thereof. Examples of the known anti-fading agents include hydroquinone derivatives, gallic acid derivatives, p-alkoxyphenols, p-oxyphenol derivatives, bisphenols, etc.

Examples of hydroquinone derivatives have been described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc., those of gallic acid derivatives have been described in U.S. Pat. Nos. 3,457,079, 3,069,262, etc., those of p-alkoxyphenols have been described in U.S. Pat. Nos. 2,735,765 and 3,698,909 and Japanese Patent Publication Nos. 20977/74 and 6623/77, those of p-oxyphenol derivatives have been described in U.S. Pat. Nos. 3,432,300, 3,573,050, 3,574,627 and 3,764,337 and Japanese Patent Application (OPI) Nos. 35633/77, 147434/77 and 152225/77, and those of bisphenols have been described in U.S. Pat. No. 3,700,455.

In the photographic light-sensitive materials of the present invention, the emulsion layers or adjacent layers thereof may contain ultraviolet ray absorbing agents as described, for example, in U.S. Pat. Nos. 3,250,617, 3,253,921, etc., for the purpose of image stabilization.

The present invention can be utilized for light-sensitive materials having a low silver content in which the amount of silver halide in the emulsions in one half to one hundredth of the conventional light-sensitive materials. In such color light-sensitive materials having a low silver halide content, sufficient color images can be obtained by an image formation process wherein the amount of dyes formed is increased by utilizing color intensification, which comprises using peroxides, cobalt complex salts or sodium chlorite as taught in German Patent Application (OLS) No. 2,357,694, U.S. Pat. Nos. 3,674,490 and 3,761,265, German Patent Application (OLS) Nos. 2,044,833, 2,056,359, 2,056,360 and 2,226,770, Japanese Patent Application (OPI) Nos. 9728/73 and 9729/73, etc.

Color development of the photographic light-sensitive materials of the present invention can be carried out by conventional processes known hitherto. Namely, it is possible to use a negative-positive process which comprises carrying out color development with substituted p-phenylenediamine to form a dye image and a silver image, processing with a bleaching bath to oxidize into a silver salt, and removing the residual silver halide and other silver salts by dissolving with a fixing bath to leave the dye image; and a color reversal process which comprises forming a negative silver image by developing with a developing agent containing a black-and-white developing agent, carrying out at least one uniform exposure or suitable fogging treatment, and subsequently carrying out color development, bleaching and fixation to obtain a dye positive image.

Further, in color X-ray films utilizing the developed silver image and the developed dye image, it is possible to use a process comprising color development and fixation which does not comprise bleaching.

The temperature of these color photographic processing is selected from a range of from 18° C. to 50° C., but it is possible to use a temperature of lower than 18° C. or higher than 50° C.

As the p-phenylenediamine derivatives for developing the photographic light-sensitive materials of the present invention, many compounds known hitherto can be used. A particularly suitable p-phenylenediamine developing agent includes N,N-dialkyl-p-phenylenediamine compounds the alkyl groups and the phenyl group of which may be substituted or unsubstituted. Among them, examples of particularly suitable compounds include N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-(β-methanesulfonamidoethyl-3-methyl-4-aminoaniline sulfate, N-ethyl-N-β-hydroxyethylaminoaniline, 4-amino-N-(2-methoxyethyl)-N-ethyl-3-methylaniline-p-toluenesulfonate, N,N-diethyl-3-methyl-4-aminoaniline, N-ethyl-N-(β-hydroxyethyl)-3-methyl-4-aminoaniline, etc.

In addition, compounds described in L. F. A. Mason, *Photographic Processing Chemistry* (published by Focal Press, 1966), pages 226–229 and U.S. Pat. Nos. 2,193,015 and 2,592,364 and Japanese Patent Application (OPI) No. 64933/73 may be used.

The color developing solution may contain pH buffer agents, development restrainers, antifogging agents, etc. If necessary, it may contain softeners, preservatives, organic solvents, development accelerators, dye forming couplers, competing couplers, fogging agents, auxiliary developing agents, thickening agents, polycarboxylic acid chelating agents, antioxidants, etc.

The bleaching processing may be carried out simultaneously with the fixing processing or these processings may be carried out separately. As the bleaching agent, compounds of polyvalent metal such as iron (III), cobalt (III), chromium (VI), copper (II), etc., peracids, quinones, nitroso compounds, etc., may be used. For example, it is possible to use ferricyanides, bichromates, organic complex salts of iron (III) or cobalt (III), complex salts of aminopolycarboxylic acids such as ethylenediaminetetraacetic acid, nitrilotriacetic acid, 1,3-diamino-2-propanoltetraacetic acid, etc., or organic acids such as citric acid, tartaric acid, malic acid, etc.; persulfates, permanganates, nitrosophenol, etc. Among them, potassium ferricyanide, sodium (ethylenediaminetetraacetato) iron (III) and ammonium (ethylenediaminetetraacetato) iron (III) are particularly preferred. The (ethylenediaminetetraacetato) iron (III) complex salts are useful for both the bleaching solution and the one-bath bleach-fix solution.

To the bleaching solution or the bleach-fix solution, it is possible to add various additives including bleaching accelerators described in U.S. Pat. Nos. 3,042,520 and 3,241,966 and Japanese Patent Publication Nos. 8506/70 and 8836/70 and thiol compounds described in Japanese Patent Application (OPI) No. 65732/78.

Examples of the fixing agent include thiosulfates (for example, ammonium thiosulfate, sodium thiosulfate, potassium thiosulfate, etc.), thiocyanides (for example, ammonium thiocyanide, sodium thiocyanide, potassium thiocyanide, etc.) and thioether compounds such as 3,6-dithia-1,8-octanediol. These compounds may be used alone or as a mixture of two or more thereof.

The present invention will now be described in more detail with reference to the following examples, but the present invention is not to be construed as being limited thereto.

EXAMPLE 1

On a cellulose triacetate support having a subbing layer was coated an emulsion layer having the composition set forth below and further on the emulsion layer was coated an aqueous gelatin solution containing each of the above described Aldehyde Scavengers (2), (3), (7), (8), (9), (11) and (25) as a protective layer to prepare Samples (A) to (G), respectively.

For comparison, Sample (H) was prepared in the same manner as described above except ethyleneurea was used as a comparative aldehyde scavenger, and Sample (I) was prepared in the same manner as described above without using any aldehyde scavenger.

Composition of Coating Solution for Emulsion Layer

Green-Sensitive Silver Iodobromide Emulsion (silver coated amount: 1 g/m$^2$)

Magenta Coupler (1)* (coated amount: $6\times10^{-4}$ mol/m$^2$)

Solvent for Dispersing Coupler: Tricresyl Phosphate

*Magenta Coupler (1)

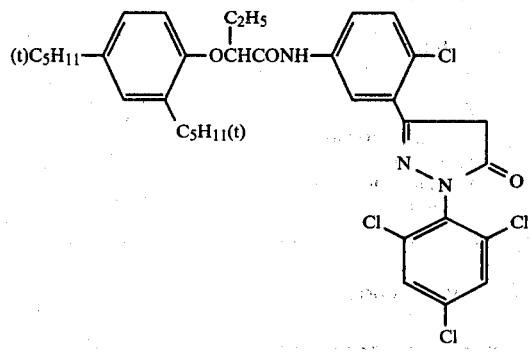

Composition of Coating Solution for Gelatin Protective Layer Containing Aldehyde Scavenger A 10% by weight aqueous solution of Aldehyde Scavenger (2), (3), (7), (8), (9), (11) or (25) was prepared and the solution was mixed with an aqueous gelatin solution to prepare a coating solution.

Aldehyde Scavenger Coated Amount: 0.6 g/m$^2$

Gelatin Coated Amount: 1.5 g/m$^2$

The above described Samples (A) to (I) were stored for 24 hours in a sealed container having an atmosphere of 40° C., relative humidity of 70% and formaldehyde gas concentration of 10 ppm. Then, the samples were exposed to light and subjected to the color development processing described below. For comparison, Samples (A) to (I) which were not brought into contact with formaldehyde gas were processed at the same time.

| Color Development Processing Step | Time | Temperature (°C.) |
|---|---|---|
| 1. Color Development | 3 min 15 sec | 38 |
| 2. Bleaching | 6 min 30 sec | " |
| 3. Washing with Water | 2 min | " |
| 4. Fixing | 4 min | " |
| 5. Washing with Water | 4 min | " |
| 6. Stabilizing | 1 min | " |

The processing solutions used in the color development processing had the following compositions:

Color Developer Solution

| | |
|---|---|
| Water | 800 ml |
| 4-(N—Ethyl-N—hydroxyethyl)amino-2-methylaniline Sulfate | 5 g |
| Sodium Sulfite | 5 g |
| Hydroxylamine Sulfate | 2 g |
| Potassium Carbonate | 30 g |
| Potassium Hydrogen Carbonate | 1.2 g |
| Potassium Bromide | 1.2 g |
| Sodium Chloride | 0.2 g |
| Trisodium Nitrilotriacetate | 1.2 g |
| Water to make | 1 l |
| | (pH 10.1) |

Bleaching Solution

| | |
|---|---|
| Water | 800 ml |
| Iron (III) Ammonium Ethylenediaminetetraacetate | 100 g |
| Disodium Ethylenediaminetetraacetate | 10 g |

-continued

| | |
|---|---|
| Potassium Bromide | 150 g |
| Acetic Acid | 10 g |
| Water to make | 1 l |
| | (pH 6.0) |

Fixing Solution

| | |
|---|---|
| Water | 800 ml |
| Ammonium Thiosulfate | 150 g |
| Sodium Sulfite | 10 g |
| Sodium Hydrogen Sulfite | 2.5 g |
| Water to make | 1 l |
| | (pH 6.0) |

Stabilizing Solution

| | |
|---|---|
| Water | 800 ml |
| Formalin (37 wt % formaldehyde) | 5 ml |
| Fuji Driwell | 3 ml |
| Water to make | 1 l |

After the color development processing, the magenta maximum color forming density of each sample was measured and the degree of decrease in magenta density due to formaldehyde gas was evaluated. The results obtained are shown in Table 1 below.

Rate of Decrease in Density =

$$1 - \frac{\text{Color Forming Density of Sample Treated with Formaldehyde}}{\text{Color Forming Density of Sample Not Treated with Formaldehyde}} \times 100$$

TABLE 1

| Sample No. | Aldehyde Scavenger Added | Rate of Decrease in Density (%) |
|---|---|---|
| A (Present Invention) | (2) | 5 |
| B (Present Invention) | (3) | 7 |
| C (Present Invention) | (7) | 11 |
| D (Present Invention) | (8) | 12 |
| E (Present Invention) | (9) | 11 |
| F (Present Invention) | (11) | 3 |
| G (Present Invention) | (25) | 6 |
| H (Comparison) | Ethylene-urea | 22 |
| I (Comparison) | — | 40 |

It is apparent from the results shown in Table 1 that the aldehyde scavengers used in the present invention exhibit an extraordinary effect.

EXAMPLE 2

On a cellulose triacetate film support were coated layers having the compositions set forth below to prepare a multilayer color photographic light-sensitive material.

First Layer: Antihalation Layer (AHL)

A gelatin layer containing black colloidal silver

Second Layer: Intermediate Layer (ML)

A gelatin layer containing a dispersion of 2,4-di-tert-octylhydroquinone

Third Layer: First Red-Sensitive Emulsion Layer ($RL_1$)

A silver iodobromide emulsion (iodide content: 5 mol%)

| | |
|---|---|
| | Silver coated amount: 1.79 g/m$^2$ |
| Sensitizing Dye I | $6 \times 10^{-5}$ mol per mol of silver |
| Sensitizing Dye II | $1.5 \times 10^{-5}$ mol per mol of silver |
| Coupler A | 0.04 mol per mol of silver |
| Coupler C-1 | 0.0015 mol per mol of silver |
| Coupler C-2 | 0.0015 mol per mol of silver |
| Coupler D | 0.0006 mol per mol of silver |

Fourth Layer: Second Red-Sensitive Emulsion Layer ($RL_2$)

A silver iodobromide emulsion (iodide content: 4 mol%)

| | |
|---|---|
| | Silver coated amount: 1.4 g/m$^2$ |
| Sensitizing Dye I | $3 \times 10^{-5}$ mol per mol of silver |
| Sensitizing Dye II | $1.2 \times 10^{-5}$ mol per mol of silver |
| Coupler A | 0.02 mol per mol of silver |
| Coupler C-1 | 0.0008 mol per mol of silver |
| Coupler C-2 | 0.0008 mol per mol of silver |

Fifth Layer: Intermediate Layer (ML)

Same as the Second Layer

Sixth Layer: First Green-Sensitive Emulsion Layer ($GL_1$)

A silver iodobromide emulsion (iodide content: 4 mol%)

| | |
|---|---|
| | Silver coated amount: 1.5 g/m$^2$ |
| Sensitizing Dye III | $3 \times 10^{-5}$ mol per mol of silver |
| Sensitizing Dye IV | $1 \times 10^{-5}$ mol per mol of silver |
| Coupler B | 0.05 mol per mol of silver |
| Coupler M-1 | 0.008 mol per mol of silver |
| Coupler D | 0.0015 mol per mol of silver |

Seventh Layer: Second Green-Sensitive Emulsion Layer ($GL_2$)

A silver iodobromide emulsion (iodide content: 5 mol%)

| | |
|---|---|
| | Silver coated amount: 1.6 g/m$^2$ |
| Sensitizing Dye III | $2.5 \times 10^{-5}$ mol per mol of silver |
| Sensitizing Dye IV | $0.8 \times 10^{-5}$ mol per mol of silver |
| Coupler B | 0.02 mol per mol of silver |
| Coupler M-1 | 0.003 mol per mol of silver |
| Coupler D | 0.0003 mol per mol of silver |

Eighth Layer: Yellow Filter Layer (YFL)

A gelatin layer containing yellow colloidal silver and a dispersion of 2,5-di-tert-octylhydroquinone Ninth Layer: First Blue-Sensitive Emulsion Layer ($BL_1$)

A silver iodobromide emulsion (iodide content: 6 mol%)

| | |
|---|---|
| | Silver coated amount: 1.5 g/m$^2$ |
| Coupler Y | 0.25 mol per mol of silver |

Tenth Layer: Second Blue-Sensitive Emulsion Layer ($BL_2$)

A silver iodobromide emulsion (iodide content: 6 mol%)

| | |
|---|---|
| | Silver coated amount: 1.1 g/m$^2$ |
| Coupler Y | 0.06 mol per mol of silver |

Eleventh Layer: Protective Layer (PL)

A gelatin layer containing 0.6 g/m$^2$ of Aldehyde Scavenger (2) and polymethyl methacrylate particles (having a diameter of about 1.5 microns)

The thus-prepared sample was designated Sample (J). In the same manner as described above except using Aldehyde Scavengers (3), (4), (8), (9), (12) and (26) in place of Aldehyde Scavenger (2) Samples (K) to (P) were prepared.

Further, Sample (Q) in which ethyleneurea was used as an aldehyde scavenger, and Sample (R) having a protective layer in which an aldehyde scavenger was not used were prepared.

The compounds used for the preparation of the above described samples were:

Sensitizing Dye I:

Pyridinium salt of anhydro-5,5'-dichloro-3,3'-di(γ-sulfopropyl)-9-ethylthiacarbocyanine hydroxide Sensitizing Dye II:

Triethylamine salt of anhydro-9-ethyl-3,3'-di(γ-sulfopropyl)-4,5,4',5'-dibenzothiacarbocyanine hydroxide Sensitizing Dye III:

Sodium salt of anhydro-9-ethyl-5,5'-dichloro-3,3'-di(γ-sulfopropyl)oxacarbocyanine Sensitizing Dye IV:

Sodium salt of anhydro-5,6,5',6'-tetrachloro-1,1'-diethyl-3,3'-di{β-[β-(γ-sulfopropoxy)ethoxy]ethyl}-imidazolocarbocyanine hydroxide Coupler A:

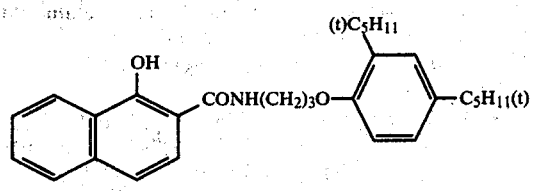

Coupler B:
Coupler Monomer (B-1)

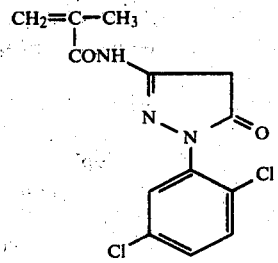

Comonomer (B-2)

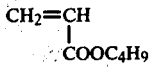

The polymer coupler consisting of Coupler Monomer (B-1) and Comonomer (B-2) was prepared so as to contain 50% by weight of Coupler Monomer (B-1).

Coupler C-1:

-continued

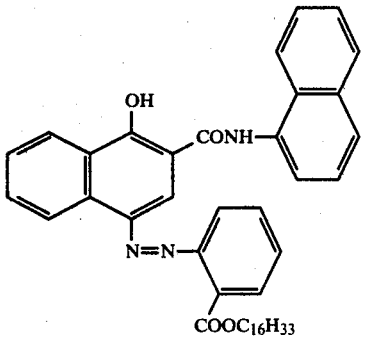

Coupler C-2:

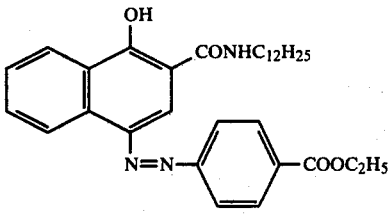

Coupler D:

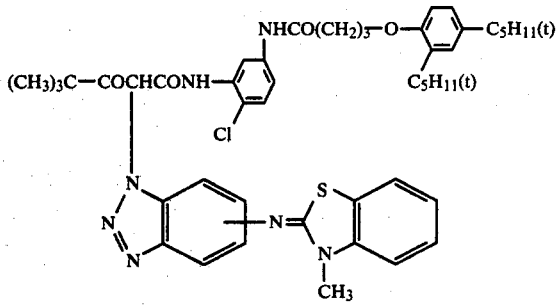

Coupler M-1:

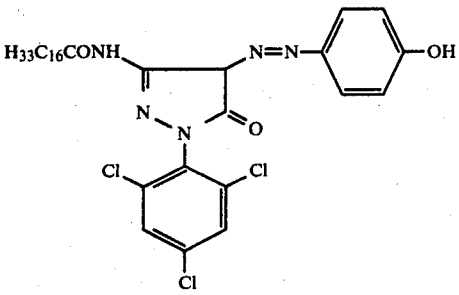

Coupler Y:

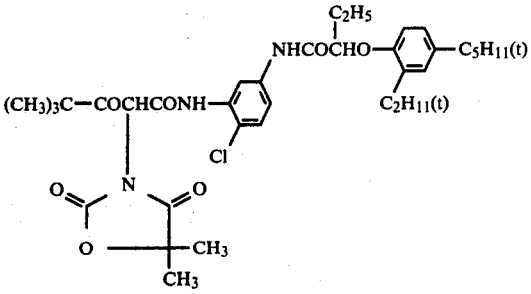

The samples prepared in the manner described above were subjected to the same color development processing as described in Example 1. The results obtained are shown in Table 2.

TABLE 2

| Sample No. | Aldehyde Scavenger Added | Rate of Decrease in Density (%) |
|---|---|---|
| J (Present Invention) | (2) | 10 |
| K (Present Invention) | (3) | 14 |
| L (Present Invention) | (4) | 12 |
| M (Present Invention) | (8) | 14 |
| N (Present Invention) | (9) | 15 |
| O (Present Invention) | (12) | 10 |
| P (Present Invention) | (26) | 15 |
| Q (Comparison) | Ethylene-urea | 30 |
| R (Comparison) | — | 53 |

It is apparent from the results shown in Table 2 that the aldehyde scavengers used in the present invention exhibit an extraordinary effect as in Example 1.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon at least one silver halide emulsion layer wherein the photographic light-sensitive material contains one or more unsubstituted or substituted glycoluril compounds.

2. A silver halide color photographic light-sensitive material as claimed in claim 1, wherein the substituted glycoluril is a water-soluble low molecular weight glycoluril compound, a glycoluril compound having an oil-soluble group or a polymeric glycoluril compound.

3. A silver halide color photographic light-sensitive material as claimed in claim 1, wherein the unsubstituted or substituted glycoluril is a compound represented by the following general formula (I):

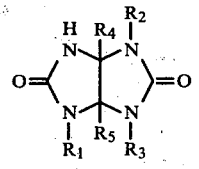

(I)

wherein $R_1$, $R_2$ and $R_3$, which may be the same or different, each represents a hydrogen atom, an alkyl group, an alkenyl group, an aralkyl group, an aryl group or an acyl group; $R_4$ and $R_5$, which may be the same or different, each represents a hydrogen atom or an alkyl group.

4. A silver halide color photographic light-sensitive material as claimed in claim 3, wherein the glycoluril compound is a polymeric compound in which a compound represented by the general formula (I) is bonded to a polymer chain through the group represented by $R_1$ or $R_3$.

5. A silver halide color photographic light-sensitive material as claimed in claim 3, wherein the glycoluril compound is a polymeric compound in which the group represented by $R_1$ or $R_3$ of the compound represented by the general formula (I) is bonded to a polymeric chain through a connecting group $$-\overset{\overset{O}{\|}}{C}-,$$

—COO—, phenylene or —CONH—.

6. A silver halide color photographic light-sensitive material as claimed in claim 1, wherein the glycoluril compound is present in a silver halide emulsion layer.

7. A silver halide color photographic light-sensitive material as claimed in claim 1, wherein the glycoluril compound is present in a subbing layer, a protective layer, an intermediate layer, a filter layer, or antihalation layer or other auxiliary layers.

8. A silver halide color photographic light-sensitive material as claimed in claim 1, wherein the glycoluril compound is present in a layer which is positioned closer to the surface than a silver halide emulsion layer, the photographic properties of which are degraded in contract with formaldehyde gas.

9. A silver halide color photographic light-sensitive material as claimed in claim 8, wherein the layer in which the glycoluril compound is present in a protective layer.

10. A silver halide color photographic light-sensitive material as claimed in claim 1, wherein the amount of the glycoluril compound is in a range of from 0.01 g to 10 g per square meter of the photographic light-sensitive material.

11. A silver halide color photographic light-sensitive material as claimed in claim 1, wherein the amount of the glycoluril compound is in a range of from 0.05 g to 5 g per square meter of the photographic light-sensitive material.

12. A silver halide color photographic light-sensitive material as claimed in claim 1, wherein the silver halide emulsion layer contains a color forming coupler.

13. A silver halide color photographic light-sensitive material as claimed in claim 12, wherein the color forming coupler is a magenta coupler, a yellow coupler or a cyan coupler.

14. A silver halide color photographic light-sensitive material as claimed in claim 12, wherein the color forming coupler is a colored coupler or a development inhibitor releasing coupler.

15. A silver halide color photographic light-sensitive material as claimed in claim 12, wherein the color forming coupler is a polymeric coupler.

16. A silver halide color photographic light-sensitive material as claimed in claim 12, wherein the color forming coupler is a 4-equivalent magenta coupler.

17. A silver halide color photographic light-sensitive material as claimed in claim 16, wherein the 4-equivalent magenta coupler is an oil-soluble magenta coupler containing a hydrophobic group, a Fisher type magenta coupler containing both a hydrophobic group and a hydrophilic group, or a magenta polymer coupler latex.

18. A silver halide color photographic light-sensitive material as claimed in claim 17, wherein the oil-soluble magenta coupler is an oil-soluble 5-pyrazolone coupler.

19. A silver halide color photographic light-sensitive material as claimed in claim 17, wherein the magenta polymer coupler latex is a polymer or copolymer having a repeating unit derived from a monomer coupler represented by the following general formula (II):

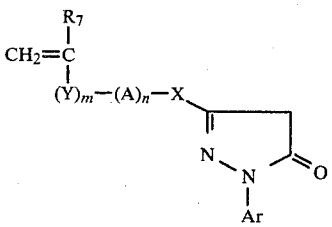

(II)

wherein $R_7$ represents a hydrogen atom, a lower alkyl group containing from 1 L to 4 carbon atoms or a chlorine atom; X represents —CONH—, —NH—, —NH-CONH— or —NHCOO—; Y represents —CONH— or —COO—; A represents a divalent connecting group which is selected from one or more members of the group consisting of a substituted or unsubstituted alkylene group having from 1 to 10 carbon atoms, a substituted or unsubstituted alkenylene group, a substituted or unsubstituted phenylene group, —O—, —S—, —SO—, —$SO_2$—, —CO—, —NH—, —CONH— or —COO—; Ar represents an unsubstituted or substituted phenyl group; m represents 0 or 1; and n represents 0 or 1.

20. A silver halide color photographic light-sensitive material as claimed in claim 19, wherein the substituent for the alkylene group, the alkenylene group or the phenylene group represented by A is an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group, or a sulfonyl group.

21. A silver halide color photographic light-sensitive material as claimed in claim 19, wherein the substituent for the phenyl group represented by Ar is an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an alkylthio group, an arylthio group, a cyano group, a nitro group, or a halogen atom.

22. A silver halide color photographic light-sensitive material as claimed in claim 19, wherein the substituent for the phenyl group represented by Ar is a halogen atom, an alkyl group, an alkoxy group, an alkoxycarbonyl group, or a cyano group.

23. A silver halide color photographic light-sensitive material as claimed in claim 19, wherein the polymer is a homopolymer.

24. A silver halide color photographic light-sensitive material as claimed in claim 19, wherein the polymer is a copolymer.

25. A silver halide color photographic light-sensitive material as claimed in claim 24, wherein the copolymer contains a repeating unit derived from a non-color forming monomer which does not couple with an oxidation product of an aromatic primary amine developing agent.

26. A silver halide color photographic light-sensitive material as claimed in claim 25, wherein the non-color forming monomer is an acrylic acid ester, an acrylic acid amide, a vinyl ester, a methacrylic acid ester, a methacrylic acid amide, an acrylonitrile, an aromatic vinyl compound, itaconic acid, citraconic acid, crotonic acid, vinylidene chloride, a vinyl alkyl ether, an ester of maleic acid, N-vinyl-2-pyrrolidone, N-vinyl pyridine, or 2- or 4-vinyl pyridine.

27. A silver halide color photographic light-sensitive material as claimed in claim 25, wherein the non-color forming monomer is an acrylic acid ester, a methacrylic acid ester or a maleic acid ester.

28. A silver halide color photographic light-sensitive material as claimed in claim 19, wherein the amount of the color forming portion in the magenta polymer coupler latex is from 5% to 80% by weight.

29. A silver halide color photographic light-sensitive material as claimed in claim 19, wherein the amount of the color forming portion in the magenta polymer coupler latex is from 20% to 70% by weight.

30. A silver halide color photographic light-sensitive material as claimed in claim 28, wherein the gram number of the magenta polymer coupler latex containing 1 mol of coupler monomer is from 250 to 3,000.

31. A silver halide color photographic light-sensitive material as claimed in claim 19, wherein the magenta polymer coupler latex is a latex prepared by an emulsion polymerization method.

32. A silver halide color photographic light-sensitive material as claimed in claim 19, wherein the magneta polymer coupler latex is a latex prepared by dissolving a lipophilic polymer coupler obtained by the polymerization of a monomer coupler in an organic solvent and then dispersing the solution in a latex form in an aqueous gelatin solution.

33. A silver halide color photographic light-sensitive material as claimed in claim 16, wherein the silver halide emulsion layer is a green-sensitive silver halide emulsion layer.

34. A silver halide color photographic light-sensitive material as claimed in claim 33, wherein the photographic light-sensitive material further comprises a blue-sensitive silver halide emulsion layer containing a yellow color image forming coupler and a red-sensitive silver halide emulsion layer containing a cyan color image forming coupler.

35. A silver halide color photographic light-sensitive material as in claim 1, wherein the unsubstituted or substituted glycoluril compounds are used in combination with other known aldehyde gas scavengers selected from the group consisting of non-cyclic ureas, cyclic ureas and active methylene compounds.

36. A silver halide color photographic light-sensitive material as in claim 1 wherein the silver halide emulsion layer comprises a binder or protective colloid comprising graft polymers which comprise gelatin and one member selected from the group consisting of acrylic acid, methacrylic acid, acrylamide, methacrylamide, and hydroxyalkyl methacrylamide.

37. A silver halide color photographic light-sensitive material as in claim 1, wherein the light-sensitive material comprises silver iodobromide.

38. A silver halide color photographic light-sensitive material as in claim 1, comprising a hydrophilic colloid layer comprising a water soluble dye selected from the group consisting of oxonol dyes, hemioxonol dyes and merocyanine dyes.

* * * * *